US005165588A

United States Patent [19]

Rowland

[11] Patent Number: 5,165,588

[45] Date of Patent: Nov. 24, 1992

[54] NAIL DRIVER AND NAIL

[76] Inventor: Donald S. Rowland, 16153 Clayton Rd., Ballwin, Mo. 63011

[21] Appl. No.: 535,790

[22] Filed: Jun. 11, 1990

[51] Int. Cl.[5] ..... B25C 1/02

[52] U.S. Cl. ..... 227/147

[58] Field of Search ..... 227/147, 149; 173/90

[56] References Cited

U.S. PATENT DOCUMENTS

| | | | |
|---|---|---|---|
| 554,908 | 2/1896 | Brunes . | |
| 975,235 | 11/1910 | Hansen . | |
| 1,024,645 | 4/1912 | Morrison | 227/147 X |
| 2,136,471 | 11/1938 | Schneider | 128/92 |
| 2,230,392 | 2/1941 | Storms . | |
| 2,328,867 | 9/1943 | Veteran . | |
| 2,488,279 | 11/1949 | Fitzmaurice et al. | 227/147 |
| 2,570,626 | 10/1951 | Abraham | 108/33 |
| 2,874,603 | 2/1959 | Boettcher . | |
| 3,370,061 | 3/1886 | Higgins et al. | 227/147 X |
| 3,693,496 | 9/1972 | Keide . | |
| 3,847,193 | 11/1974 | Brunstetter | 227/147 |
| 3,934,779 | 1/1976 | Dent | 227/147 |
| 4,557,409 | 12/1985 | Hecock et al. | 227/147 |
| 4,856,697 | 8/1989 | Duffee | 227/149 |
| 4,858,814 | 8/1989 | Francis | 227/149 |

FOREIGN PATENT DOCUMENTS

| | | | |
|---|---|---|---|
| 1392574 | 2/1965 | France | 227/147 |
| 507218 | 6/1939 | United Kingdom | 227/147 |

*Primary Examiner*—Douglas D. Watts
*Assistant Examiner*—Rinaldi Rada
*Attorney, Agent, or Firm*—Heller & Kepler

[57] ABSTRACT

A nail driver apparatus and a nail directed to joining abutting wood members with headless opposing points nails has a driver and opposing points nail for driving a blind or concealed nail. The driver apparatus includes a preferred means for driving and guiding a headless opposing points fastener by means of a percussive driving force, such as a hammer blow to a shaft member, and for protecting a point of the nail or fastener inserted into the driver.

24 Claims, 7 Drawing Sheets

NAIL DRIVER AND NAIL

BACKGROUND OF THE INVENTION

The present invention relates in generally to building tools and methods and pertains, more particularly, to a nail driver apparatus and a nail directed to joining abutting wood members with headless nails. The driver and opposing points nail of this invention are an improvement over the conventional blind or concealed nail and associated driver devices and methods.

With the conventional hammer and headed nail it is generally necessary to construct walls or decks with "toe nail" style construction. For example, it is common to drive nails, e.g., box nails, common nails, finishing nails, and concrete nails by striking the nail head with a hammer or using a conventional percussive charge device.

Furthermore, it is known to provide specialty nails and associated drivers. The following are examples of disclosures of such devices and fasteners. The Boettcher reference, U.S. Pat. No. 2,874,603, shows a nail having a frangible extension from the head which enables the nail to be driven in places where the head must be recessed. Thus, once the nail is driven, the frangible extension is knocked off.

The Abraham reference, U.S. Pat. No. 2,570,626, shows a roofing fastener which includes a conventional roofing nail with a conventional head and a second point extending from the nail head. The second point is bent over and holds over previously laid shingles. A magnetized cap fits over the second point to reset on the head and drive the nail.

The Brunes reference, U.S. Pat. No. 554,906, shows a blind nailing device with a double ended perforated brad. An offset provides a driving head and a perforation and allows a conventional common nail to be driven through it and hold the brad in place.

The Keide reference, U.S. Pat. No. 3,693,496, shows several variations of a concealed, opposing points nail. A center head limits nail travel. Alternatively, the nail provides offset points with detachable heads.

The Hansen reference, U.S. Pat. No. 515,391, shows a nail wedge. The nail head has wings which fold down to expose a point extending from the head. The Storms reference, U.S. Pat. No. 2,230,397, shows a double pointed nail with a center head for use in capping posts. The Veteran reference, U.S. Pat. No. 2,328,867, shows a double pointed nail with offset points to secure ties and similar members.

Conventional types of hammers, generally with some sort of hammer head, for hitting or driving nails with the head, are known. For example, a fastener driving tool is shown in the Dent reference, U.S. Pat. No. 3,934,779, wherein an elongated driving shaft and handle drive hard-to-reach nails. The Brunstetter reference, U.S. Pat. No. 3,847,193, shows a nail-screw holder that provides an extension to start nails in hard-to-reach locations.

These conventional nails and drivers are used to drive the nail by striking the head. The nail head is typically visible after the nail is driven. This is an aesthetically undesirable sight in many types of wood construction. Another drawback associated with the conventional nail and driver is use of "toe nail" construction to fasten abutting members.

Existing wooden construction, particularly log and spike construction, requires driving large spikes and often pre-drilling pilot holes where a large spike nail is driven through one log into another log below. The same is true in construction of retaining walls made of railroad ties or timbers. A drawback associated with this construction is requiring oversize conventional spike nails just to allow them to be driven completely through one log and penerate the next adjacent log.

When the necessity of driving completely through a member into the next adjacent member is eliminated, the construction exemplified above can be accomplished with smaller headless nails with their opposing points at the ends of the nail shaft.

It should be further appreciated that driving a spike or nail into more than one member of any particularly or relatively hard wood could be difficult or impossible. This drawback is surmounted by use of a smaller, easier to drive headless nail.

Gluing could be an alternative choice, yet it too has its drawbacks. Gluing often requires use of a tack or small nail. Clamping is also an alternative; however, either it or gluing may be impossible or undesirable.

Accordingly, it is an object of the present invention to provide an improved nail and nail driver that provide a fastener and tool for of nailing wooden objects together. With the nail and driver of this invention the nail head is concealed by the constructed object.

Another object of the present invention is to provide an improved headless fastener with a nail comprising opposing point portions and an intermediate shaft portion. In one embodiment the shaft portion includes means for preventing the fastener from being easily removed from a receiving member. In a preferred embodiment the shaft portion of the headless fastener or nail may include longitudinally spaced, outward projecting rings.

A further object of the present invention is to provide an improved nail and driver that provide means for driving an opposing points nail without damage to the point.

Still another object of the present invention is to provide an improved nail and driver that will set the headless nail into a wood member to a pre-determined depth.

SUMMARY OF THE INVENTION

To accomplish the foregoing and other objects of this invention there are provided a headless fastener and an associated driver apparatus for driving the headless fastener into a receiving member. The opposing end of the headless fastener extends out of the receiving member and another receiving member is fastened to it. The two members are fastened together and the fastener is concealed.

The driver apparatus comprises a driving means adapted for driving the headless fastener and guiding the headless fastener a determined depth into the receiving member, thereby leaving a determined length of the headless fastener exposed to enter and fasten the other receiving member in place.

The present invention includes a headless fastener adapted for use with the driver. The headless fastener has a shaft with opposing points at either end. In a preferred embodiment the point portions include conventional, relatively flat surfaces separated by feathering. The flat surfaces are captured in the driver apparatus which further provides for protection of the point portions as the headless fastener or nail is driven into the receiving member.

In one disclosed embodiment described herein, there are provided a nail of the present invention and a driver apparatus consisting of a driver shaft which holds the nail in one end, the other end being designed to receive a percussive blow such as is produced when struck with a hammer. A sleeve or handle is positioned over the shaft and can be used to hold the driver assembly in position while the driver shaft is struck with sufficient hammer blows to insert the exposed or extended point of the fastener into the receiving member.

A compressive bearing assembly or a suitable sized fastener guide is used to substantially grip the fastener or nail during use of the driver apparatus.

These and other objects and features of the present invention will be better understood and appreciated from the following detailed description of preferred embodiments thereof, selected for purposes of illustration and shown in the accompanying drawings.

DETAILED DESCRIPTION

Figure 1:
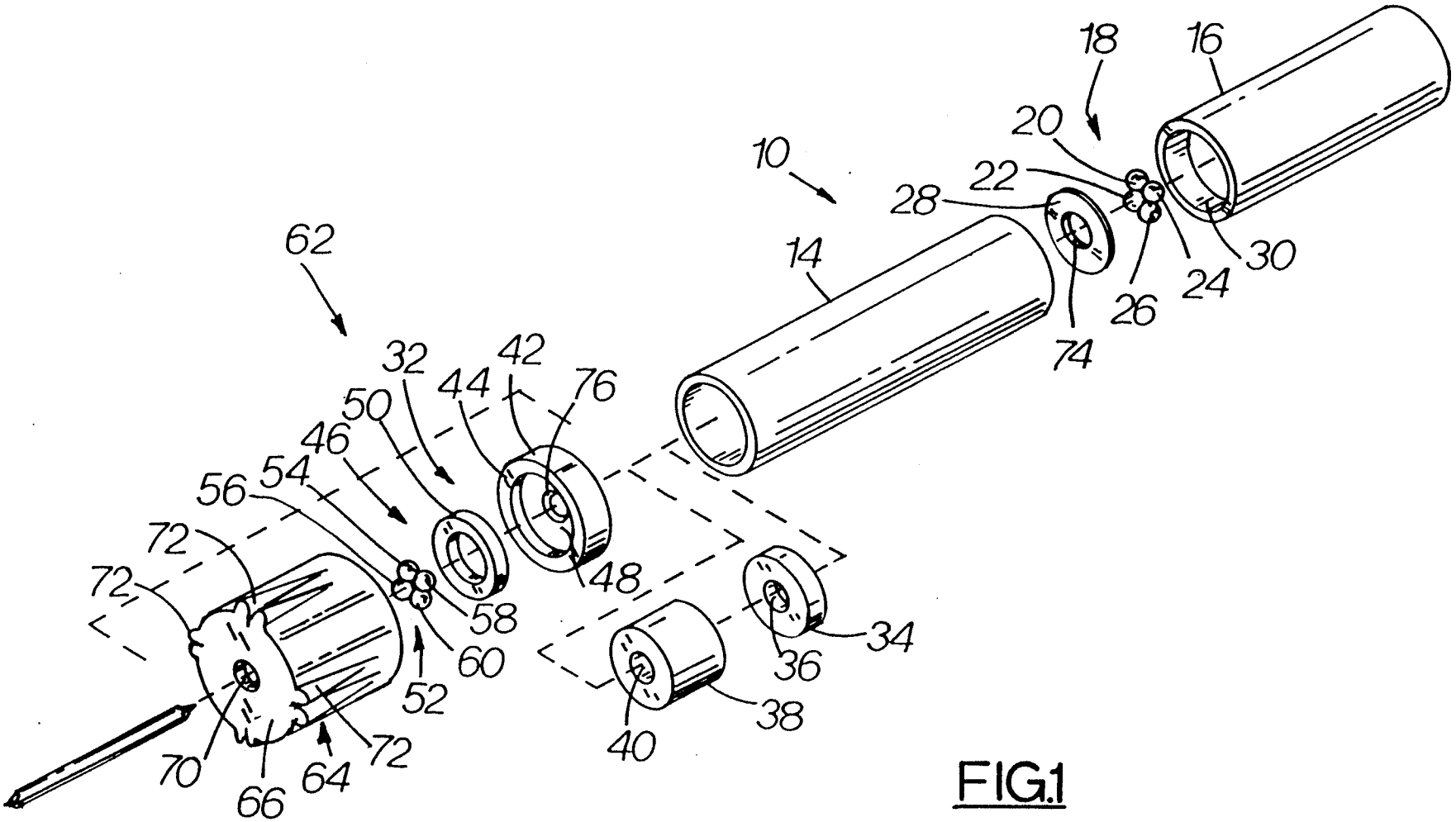
FIG. 1 is an exploded view of a preferred embodiment of a driver apparatus constructed in accordance with the present invention illustrating a headless fastener.

Referring now to the drawings there is shown a preferred embodiment for the driver apparatus and headless fastener or nail of this invention in FIGS. 1 through 5, 19, 20, and 23. Other embodiments of the present invention are also illustrated for purposes of clarity and for the further understanding of the scope of this invention. The driver apparatus and headless fasteners are described in connection with a wooden construction assembly.

The driver apparatus and headless fastener of the present invention are particularly adapted for providing an improved construction technique which is characterized by an improved structural system and aesthetically pleasing finished product.

The drawings show a driver apparatus including a preferred means for driving and guiding a headless fastener of this invention by means of a percussive driving force, such as a hammer blow to a shaft member. As will be further described, the driver apparatus of this invention also includes means for establishing the driving depth of the headless fastener into a receiving member.

A driver assembly 10 is illustrated for a headless nail 12 with opposing, otherwise conventional points. The driver assembly 10 includes a driver housing or sleeve handle 14. The housing 14 slides into position over the driver shaft 16. A point receiving ball bearing assembly 18 captures the point of the nail and protects the point of the nail from flattening during use of the driver apparatus. The ball bearing assembly 18 and ball bearings 20, 22, 24, and 26 located within an assembly keeper 28 provide the desired fastener or nail point holding means.

Figure 2:
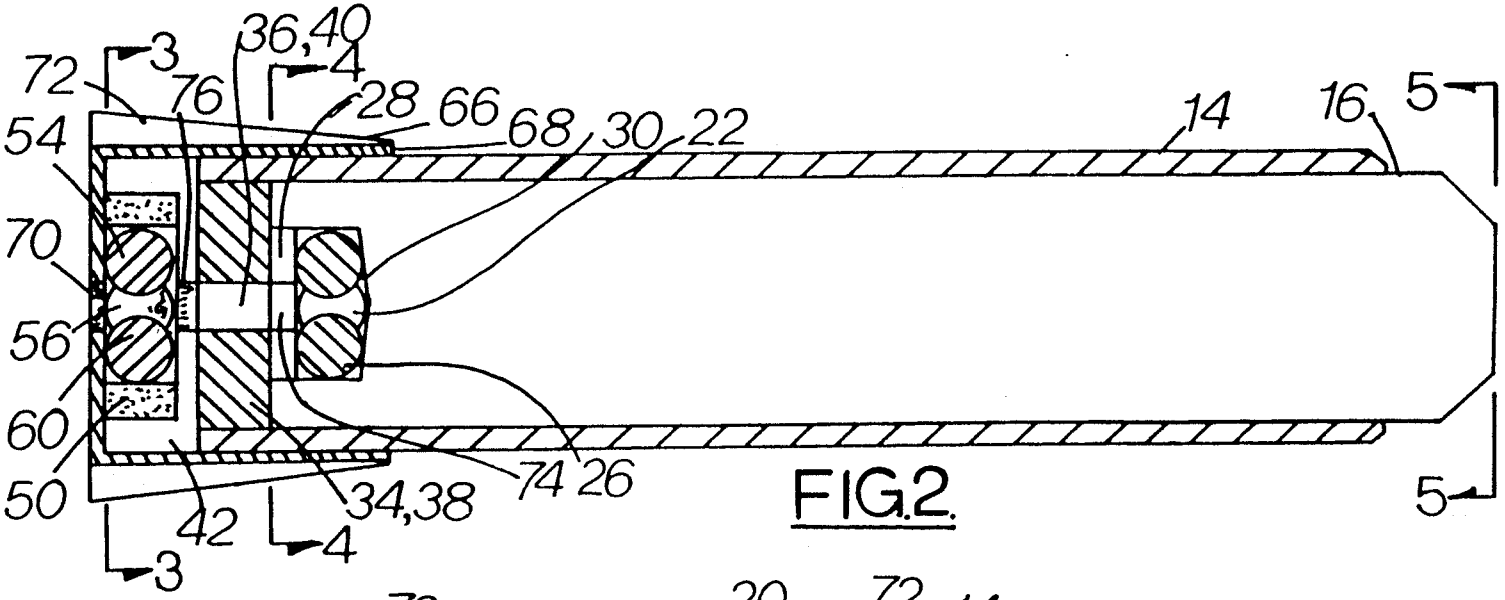
FIG. 2 is a cross-sectional view of the driver apparatus depicted in FIG. 1 taken along the center line of the driver.
Figure 5:
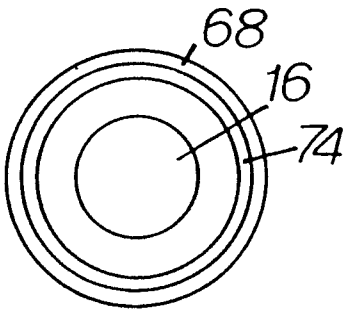
FIG. 5 is a cross-sectional view taken along line 5—5 in FIG. 2.
Figure 4:
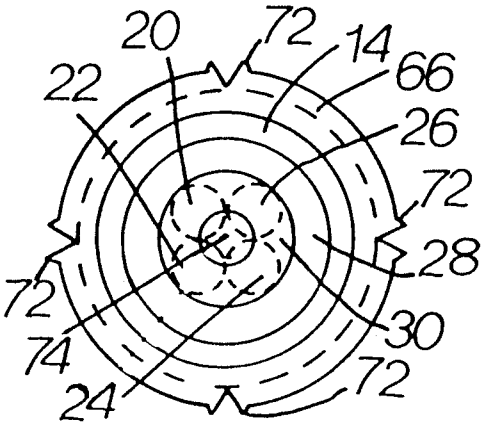
FIG. 4 is a cross-sectional view taken along line 4—4 in FIG. 2.
Figure 3:
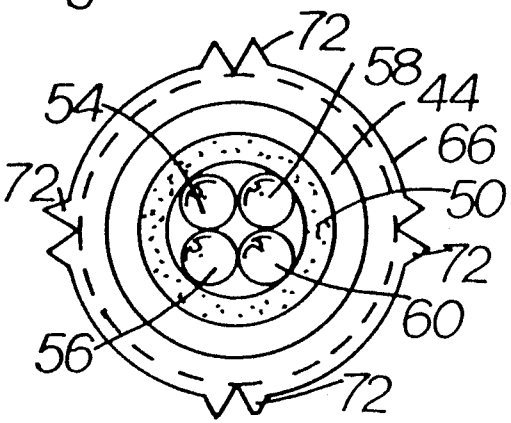
FIG. 3 is a cross-sectional view taken along line 3—3 in FIG. 2.

In a preferred embodiment the driver shaft 16 is a solid circular shaft having a ball bearing assembly receiving recess 30 at one end. The struck end of the driver shaft 16 may have a slight taper as illustrated in FIGS. 2 and 5 in order to prevent mushrooming while being struck with a hammer (not shown). The driver shaft 16, as illustrated and described, is round. Other shapes or stock may be used, such as square, hexagonal, or octagonal.

The driver shaft 16 is made from a material which can withstand repeated hammer blows without distortion and transfer the force ("F1") of the blow to the nail being driven without distortion.

It will be understood that the sleeve handle 14 provides a manner in which to hold the driver assembly 10 in position while the headless nail 12 is positioned with respect to the receiving member and driven in to the receiving member as described in further detail below.

A preferred embodiment of the headless nail 12 will now be described in order to clarify certain features of the nail itself and portions of the driver assembly of this invention. The fastener or nail is elegant in its form yet it has required the development of the driver apparatus of this invention to provide a manner in which to drive the nail without damaging the nail point captured within the driver apparatus.

Figure 20:
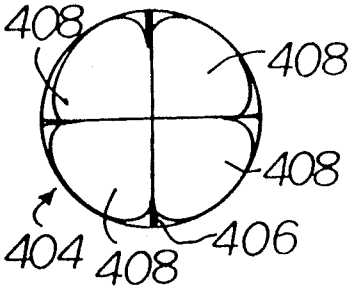
FIG. 20 is an end view of the headless fastener depicted in FIG. 19.
Figure 23:
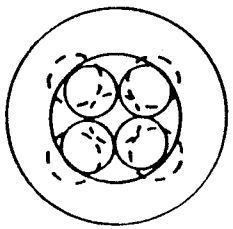
FIG. 23 is an elevation view of a compressive fastener assembly constructed in accordance with this invention.
Figure 19:
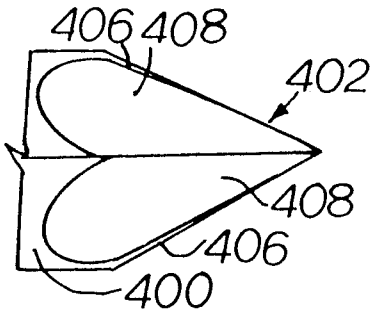
FIG. 19 is an elevation or plan view of a preferred embodiment of a headless fastener manufactured in accordance with the present invention.
Figure 22:
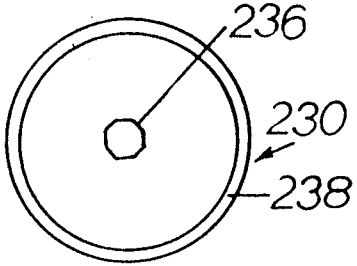
FIG. 22 is an end view of a driver apparatus illustrating a fixed size fastener or nail guide.

A preferred embodiment of the headless fastener or nail 400 is illustrated in FIGS. 19 and 20 and includes a nail point portion 402 and an opposing nail point portion 404. A typical nail point is manufactured with a plurality of feathered portions 406. These feathered portions are a result of a typical nail manufacturing process.

Conventional nail pointing processes create four flat surfaces that together form what could be called a compound wedge. It will be understood that the following description presumes the creation of four surfaces on a nail point. It will be further understood that should it be desired, for whatever reason, to manufacture a nail with more or less generally flat wedge surfaces, then the capture assembly, e.g., the number of ball bearings provided. can be readily modified to suit the nail point created by the particular pointing process.

In the illustrated embodiment a round shaft portion 410 is depicted. However, it will be understood that the shaft can be manufactured with any desired cross-section, for example, square, hexagonal, octagonal, or any other commonly used shape. The diameter and length of the shaft may vary depending on the particular application. As an example, the diameter and length for use in decking would be greater than the diameter and length used in furniture or cabinet work. The nail could be manufactured in all penny sizes commonly used in the nail industry.

The ball bearing assembly 18 provides a plurality of ball bearings which contact the generally flat wedge surfaces 408 of the opposing points nail 12 or 400. The assembly is housed in a ball bearing receiving recess 30. As previously described, the preferred embodiment includes four (4) ball bearings and each contacts a flat surface 408.

It will be appreciated from the description and the drawings that impact or percussive force F1 created, for example by a hammer blow, is transferred from the driver shaft 16 through the ball bearings and to the wedge surfaces of the headless nail 12. The bearings assembly protects the point of the nail 12 against damage.

The bearings assembly keeper 28 retains the ball bearings within the bore on the driver shaft 16. The bearing keeper 28 is generally washer shaped having a center opening and connects to the end of the driver shaft 16. The center opening of the bearings assembly keeper 28 is provided of a sufficient size to accommodate the points of all the various sizes of opposing points nails.

A preferred embodiment of the present invention includes a means for accepting different nails in a range of diameters. A preferred embodiment of this invention includes means for varying the depth the nail is driven into a receiving member, such as a landscaping timber or deck plank, by driving farther into the former and not as far into the latter.

Nail depth selection is accomplished in one preferred embodiment by use of one or more depth selection spacers 34 or 38, shown for purposes of illustration. More than two depth selection spacers could be provided if desired, and the assembly 10 modified accordingly. Referring to the illustrated embodiment, the spacers are generally cylindrical and have axial, longitudinal nail receiving bores 36, and 40, respectively.

The depth selection spacers are provided to control and vary the depth to which the nail 12 will be driven. The depth selection spacers are typically cylindrical in shape with a center bore larger than the diameter of the largest nail which the nail driver assembly accommodates. The available length of the depth selection spacers is intended to vary over a desired range of lengths. Furthermore, the spacers are intended for use either individually or in combination to achieve the desired depth.

In a preferred embodiment, the depth selection spacers 34, 36 have an outer diameter slightly less than the inside diameter of the driver housing sleeve handle 14. The depth selection spacer or spacers fit individually or in combination into the sleeve handle 14 and against the end of the driver shaft 16 and, more particularly, the portion of the driver shaft 16 defining the ball bearings assembly recess 30.

In order to provide a variable diameter guide feature of a preferred embodiment, a compression bearings assembly 32 is provided and includes a bearings housing 42 with a peripheral side wall 44. A compression assembly 46 of one preferred embodiment is received in a compression assembly receiving recess 48 defined by the housing 42 and the wall 44. A compression ring 50 provides a receiving member for a friction bearings assembly 52. In a preferred embodiment the friction bearings assembly 52 includes four suitably sized ball bearings 54, 56, 58, and 60.

Referring to FIGS. 1–5 and 23, it will be observed that the compression ring 50 maintains the ball bearings 54–60 in position within a headless nail variable diameter nail guide assembly 62. The compression ring 50 biases the ball bearings into contact with each other, thereby defining a central, longitudinal nail receiving opening that accepts insertion of a point portion of one end of the opposing points headless nail.

Insertion of one point portion of the opposing points headless nail engages the wedge surfaces of the nail point with their respective ball bearing and forces the ball bearings ultimately into a position indicated by reference characters 54'–60'. As the nail is further inserted the ball bearings 54, 56, 58 and 60 are forced outward from the nail while still creating a friction force to hold the nail shaft.

In a preferred embodiment the ball bearings are forced into the compressible bearing ring material. The bias of the compression ring 50 urges the ball bearings against the shaft of the headless nail and holds the nail in place within the driver assembly 10.

In one preferred embodiment the compression ring 50 is a relatively soft, compressible rubber material of the type which readily compresses on the ball bearings while urging the bearings inwardly against the headless nail shaft. It will be understood that while a rubber material is suggested, any other suitable material may be used without departing from the scope of this invention. It has been further observed that the bearings tend to roll within the compression ring, thereby subjecting different portions of the compression ring to the crush of the bearings.

It is expected that the rolling of the bearings in the compression ring prolongs the life of the compression ring. Furthermore, in view of the assembly of this invention, the compression ring may be replaced.

The compression ring 50, the bearings assembly and the other elements of the headless nail variable diameter nail guide assembly 62 provide a centrally located, longitudinal opening for receiving the headless nail as the nail is inserted to the headless nail opposing point receiving ball bearings assembly 18. The compression ring is typically washer shaped. The opening in the compression ring 50 should be slightly larger than the diameter of the largest headless opposing points nail 12 which the particular driver assembly 10 is designed to accommodate.

A nail guide holder 64 is provided to secure the variable diameter assembly 62 and chosen depth selector spacers or shims in place at one end of the driver shaft 16. The holder 64 is a hollow or recessed housing member 66 in which the hollow or recess is defined by a generally cylindrical peripheral side wall 68. A nail receiving bore 70 in an end of the housing member 66 receives an end of the headless opposing points nail 12.

The end of the housing defining the bore 70 is preferably flat to facilitate contact with a nail receiving surface of the receiving member as the headless nail 12 is driven with the force F1. The bore 70 should be centered in the flat bottom of the nail guide holder 64 and should provide a nail receiving bore slightly larger than the diameter of the largest headless nail accommodated by the nail driver assembly 10.

Gripping projections 72 may be provided to facilitate holding the nail driver assembly 10 during use and when loading headless opposing points nails 12 into the driver assembly 10. The projections provide a cross-hair like arrangement for aligning the driver over a location on the receiving member to drive the headless opposing points nail. The location would be marked with at least two crossed lines on the receiving member and the lines would be extended sufficiently to extend past the projections 72 when placed on the receiving member.

The driver is then located on the receiving member with little or no nail point protruding since the driver shaft extends out of the driver housing sleeve handle, thus allowing the projections to be aligned with the previously located crossed lines. This operation would be typical for any embodiment of the invention with the telescoping or equivalent arrangement between the driver shaft and the driver housing sleeve handle.

As an added plus, the projections furthermore keep the driver from rolling away or out of reach when it is put down on anything other than a flat surface.

The headless opposing points nail 12 is inserted through the opening defined by the bore 70 for positioning within the nail driver assembly 10. The headless opposing points nail 12 is inserted into and through a nail point receiving bore 74 defined by the ball bearings assembly keeper 28. An opening 76 defined by the bearings housing 42 receives the point and shaft of the headless nail 12. The driver shaft 16 slides out of the driver housing sleeve handle 14 as the headless opposing points nail 12 is inserted and positioned within the driver assembly 10.

The nail guide holder 64 is illustrated as having a press or friction fit with the driver housing sleeve handle 14. It will be understood that other means for securing the holder to the shaft are available. Similarly, the housing could fit over the holder, or another arrangement could be provided to provide the desired interfitting relationship between the described elements of the nail driver assembly 10. For example, it would be possible to provide other connection schemes, including threads, or a snap ring assembly without departing from the scope of the present invention.

Figure 6:
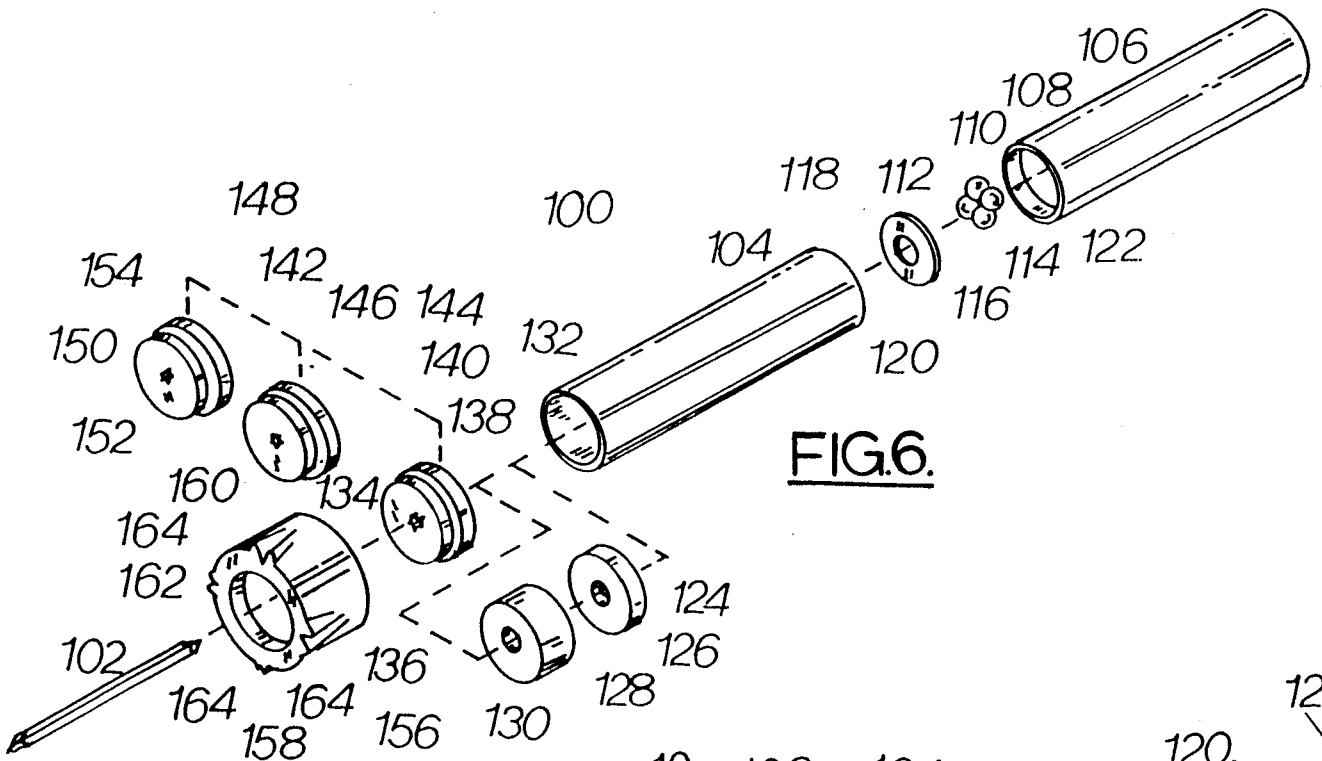
FIG. 6 is an exploded view of another preferred embodiment of a driver apparatus constructed in accordance with the present invention illustrating possible alternative constructions of various features of this invention.

Having described the preferred embodiment additional embodiments will now be described. Referring to FIG. 6 there is shown a nail driver assembly 100 of this invention. The nail driver assembly 100 is generally characterized by a fixed diameter nail guide assembly rather than the headless nail variable diameter nail guide assembly 62 illustrated and described with respect to the foregoing embodiment of this invention.

A headless opposing points nail 102 is held within a driver housing sleeve handle 104 and driver shaft 106 of the nail driver assembly 100. In the embodiment depicted in FIGS. 6–10 a headless nail point receiving ball bearings housing 108 operatively confines a plurality of ball bearings 110 through 116. The plurality of ball bearings are further retained by a ball bearings assembly keeper 118 illustrated as a cover, a shield or the equivalent.

It will be understood that the number of ball bearings will vary with the design of the headless opposing points nail 102 and, more particularly, the number of pointing flats manufactured in the opposing points of the nail. This applies to the previously described embodiment as well as the present embodiment.

The presently described embodiment is similar to the previous embodiment and, in particular, the arrangement of the headless nail point receiving ball bearings assembly 108 which captures one of the opposing points of the nail in order to protect the point of the nail from flattening during use of the nail driver assembly 100.

The headless nail point receiving ball bearings assembly 108 and ball bearings 110, 112, 114, and 116, all generally restrained by the assembly keeper 118, provide the desired fastener or nail point holding means. The nail point is received into the assembly 108 through a headless nail point receiving bore 120.

Figure 7:
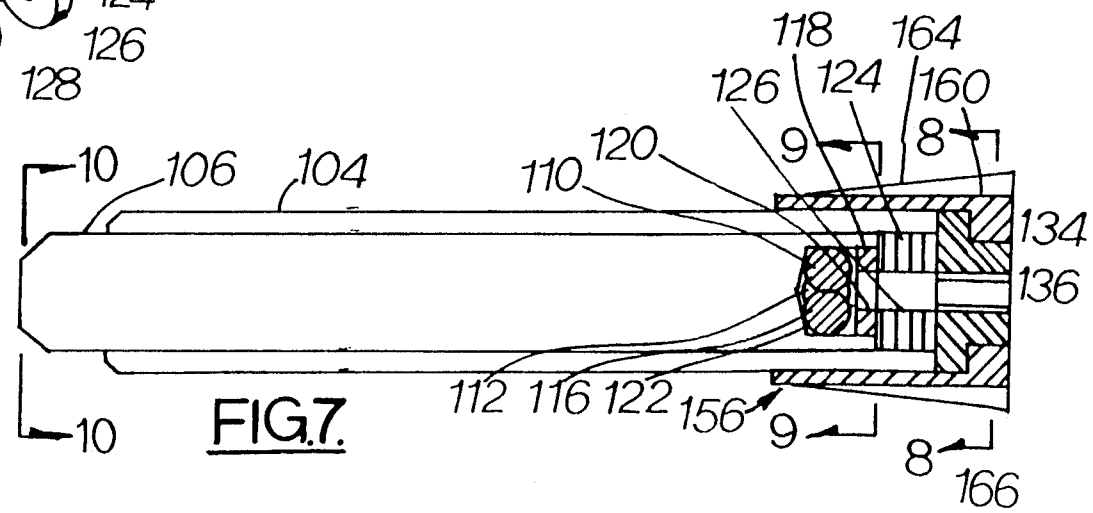
FIG. 7 is a cross-sectional view of the driver apparatus depicted in FIG. 7 taken along the center line of the driver.
Figures 8, 9, 10, 11, 12, 13, 14, 15:
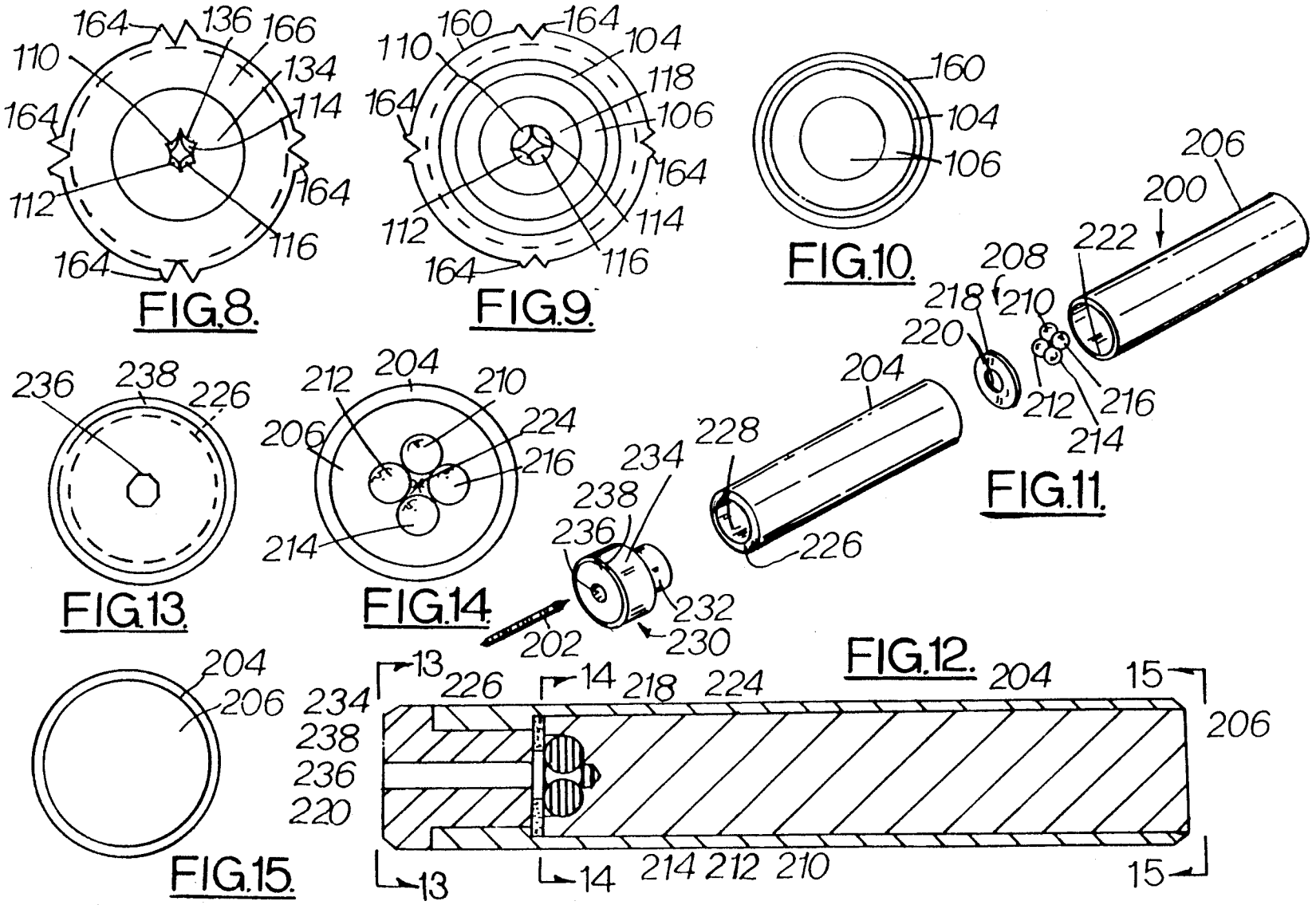
FIG. 8 is a cross-sectional view taken along line 8—8 in FIG. 6.
FIG. 9 is a cross-sectional view taken along line 9—9 in FIG. 7.
FIG. 10 is a cross-sectional view taken along line 10—10 in FIG. 7.
FIG. 11 is an exploded view of another preferred embodiment of a driver apparatus constructed in accordance with the present invention illustrating another possible alternative construction of various features of this invention.
FIG. 12 is a cross-sectional view of the driver apparatus depicted in FIG. 11 taken along the center line of the driver.
FIG. 13 is a cross-sectional view taken along line 13—13 in FIG. 12.
FIG. 14 is a cross-sectional view taken along line 14—14 in FIG. 12.
FIG. 15 is a cross-sectional view taken along line 15—15 in FIG. 12.

In the illustrated embodiment of FIGS. 6–10 the driver shaft 106 is again a solid circular shaft having a ball bearings assembly receiving recess 122 at one end. The struck end of the driver shaft 106 may have a slight taper as illustrated in FIGS. 7 and 10 in order to prevent mushrooming while being struck with a hammer (not shown).

The driver shaft 106, as illustrated and described, is round. It will be understood from the previous description of another preferred embodiment that other shapes or stock may be used, such as square, hexagonal, or octagonal in which the driver 106 may be manufactured. The driver shaft 106 is made from a material which can withstand repeated hammer blows without distortion and transfer the force ("F1") of the blow to the nail being driven without distortion of the driver shaft.

It will be further understood that the sleeve handle 104 provides a manner in which to hold the driver assembly 100 in position while the headless opposing points nail 102 is positioned with respect to the receiving member and driven in to the receiving member.

This embodiment of the present invention is further characterized by the replacement of the compressible, variable diameter headless nail opposing points guide assembly 62 by an interchangeable, fixed diameter nail guide 132, or 140, or 148. However, even with this variation, the nail driver assembly is adapted to provide a variety of nail depth selection spacers.

Nail depth selection is accomplished in the preferred embodiment presently described in the same fashion as the preceding embodiment. A plurality of depth selection spacers 124 or 128 is depicted for purposes of illustration. More than two depth selection spacers could be provided if desired, and the assembly 100 modified accordingly. Referring to the illustrated embodiment, the spacers are generally cylindrical and have axial, longitudinal headless opposing points nail receiving bores 126 or 130.

The depth selection spacers, as previously described, are provided to control and vary the depth to which the headless opposing points nail 102 will be driven. The depth selection spacers are typically cylindrical in shape with a center bore larger than the diameter of the largest nail which the nail driver assembly accommodates. The available length of the depth selection spacers is intended to vary over a desired range of lengths. Furthermore, the spacers are intended for use either individually or in combination to achieve the desired depth.

The variation of the present embodiment involves one or more removable and interchangeable nail guides depicted in the drawing figures as reference characters 132, 140, and 148. The typical removable and interchangeable nail guide is a circular disk having a nail guide core portion 134, 142 or 150, respectively, and an axial headless opposing points nail receiving bore 136, 144 or 152, respectively.

Each nail guide receiving bore has a fixed diameter slightly larger than a particular nail size. The nail guides are interchangeable and are intended to be changed to the correct size bore as a user of the nail driver assembly 100 changes nail sizes.

Each nail guide has a core diameter to allow the nail guide to fit into the assembly and a flange 138, 146 or 154, used to hold the nail guide in place in the assembly and, more particularly, in a nail guide holder 156 within a hollow or recessed housing 158 defined by the nail guide holder 156 and a generally cylindrical peripheral side wall 160.

The nail guide core with its smaller diameter is sized to fit into a nail guide core receiving bore 162 defined by the nail guide holder 156. The assembly is intended to fit together such that when positioned for driving the headless opposing points nail a generally flat surface of the nail guide 132, 140 or 148 is flush with the flat surface of the nail guide holder 156.

In addition to the gripping projections 164 associated with the nail guide holder 156 is an inner projecting flange portion 166 which cooperates with the flange 138, 146, or 154 to maintain the respective nail guide in position within the assembly 100. The nail guide is readily changed by simply removing the nail guide holder 156 from the end of driver housing sleeve handle 104, dropping out one nail guide and inserting another nail guide. The projections 164 operate as previously described to provide a cross-hair arrangement and to keep the driver from rolling away.

It will be understood from the foregoing description that the nail guide holder may have a press or friction fit with the driver housing sleeve handle 104. It has already been discussed that other means for securing the holder to the shaft are available.

Similarly, the housing could fit over the holder, or another arrangement could be provided to provide the desired interfitting relationship between the described elements of the nail driver assembly 100. For example, it would be possible to provide other connection schemes, including threads, or a snap ring assembly without departing from the scope of the present invention.

The present invention suggests other embodiments that include fewer elements and features, yet still contain the substance of the present invention. Referring now to FIGS. 11 through 15 there is shown another embodiment of the present invention as a nail driver assembly 200 for driving a headless opposing points nail 202. This assembly 200 includes a driver housing 204 and a driver shaft 206.

It will be noted that the assembly 200 also includes a headless opposing points nail point receiving ball bearings assembly 208. This embodiment depicts the use of four ball bearings 210, 212, 214, and 216 since it is presumed that the opposing points of nail 202 have four pointing flats or wedge surfaces.

The presently described embodiment is similar to the previous embodiments and, in particular, the arrangement of the headless opposing points nail point receiving ball bearings assembly 208 captures one of the opposing points of the nail in order to protect the point of the nail from flattening during use of the nail driver assembly 200.

The headless nail point receiving ball bearings assembly 208 and the ball bearings 210, 212, 214, and 216, are all generally restrained by a ball bearings assembly keeper, cover, or shield 218, to provide the desired nail point holding means. The nail point is received into the assembly 208 through a headless opposing points nail point receiving opening 220.

In the illustrated embodiment of FIGS. 11 through 15, the driver shaft 206 is depicted as a solid circular shaft having a ball bearings assembly receiving recess 222 at one end. The struck end of the driver shaft 206 may have a slight taper as illustrated in FIGS. 12 and 15 in order to prevent mushrooming while being struck with a hammer (not shown).

A nail point receiving recess 224 is provided in this embodiment to allow for passage of the nail point into and partially through the ball bearings assembly 208. The recess is an alternative construction to the slightly tapered recesses illustrated in the previously described embodiments.

The driver shaft 206, as presently illustrated and described, is round. It will be understood from the previous description of another preferred embodiment that other shapes or stock may be used, such as square, hexagonal, or octagonal in which the driver 206 may be manufactured. The driver shaft 206 is made from a material which can withstand repeated hammer blows without distortion and transfer the force ("F1") of the blow to the nail being driven without distortion of the driver shaft.

It will be further understood that the driver housing 204 provides a manner in which to hold the driver assembly 200 in position while the headless opposing points nail 202 is positioned with respect to the receiving member and driven into the receiving member.

The nail driver assembly is retained in part by a driver housing flange 226 that defines a nail guide receiving bore 228 for receiving a nail guide 230. The nail guide 230 includes a nail guide core portion 232 which is intended to abut the ball bearings assembly keeper 218 to retain the ball bearings assembly 208 within the receiving recess 222. A nail guide flange 234 abuts the end of the driver housing flange 226 and further includes a headless opposing points nail receiving bore 236. A bevel 238 is provided on a peripheral edge of the nail guide.

Figure 16:
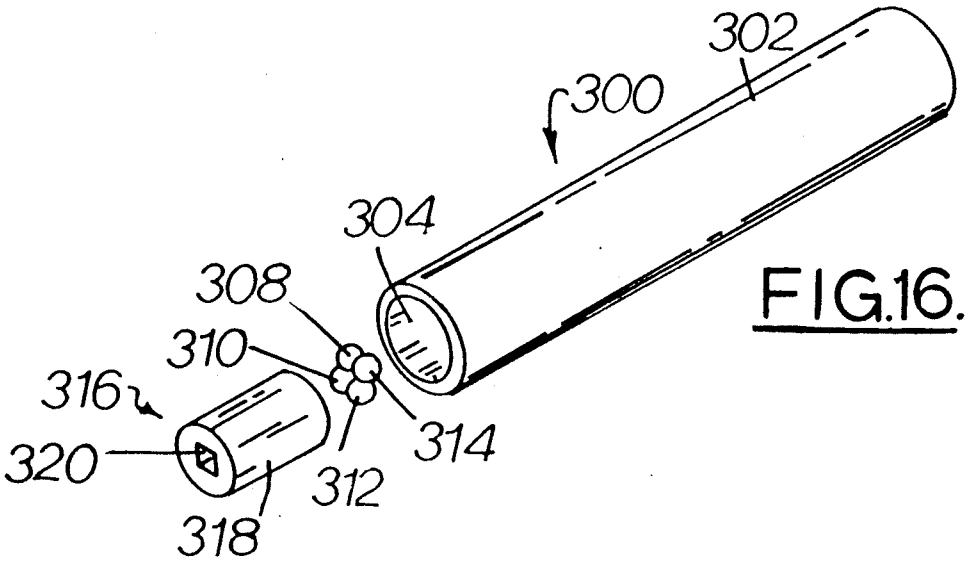
FIG. 16 is an exploded view of another preferred embodiment of a driver apparatus constructed in accordance with the present invention illustrating another possible construction of the driver apparatus of this invention.
Figure 17:
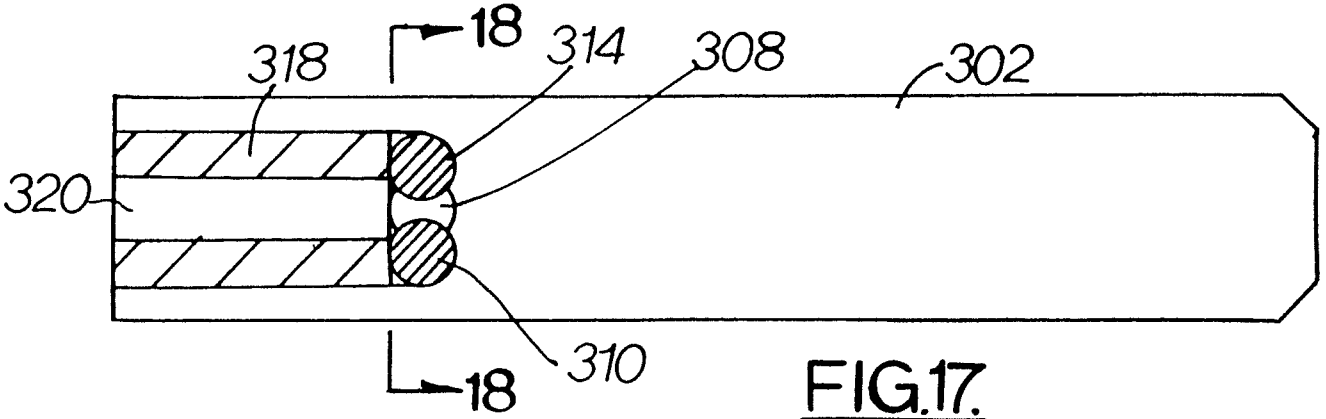
FIG. 17 is a cross-sectional view of the driver apparatus depicted in FIG. 16 taken along the center line of the driver.
Figure 18:
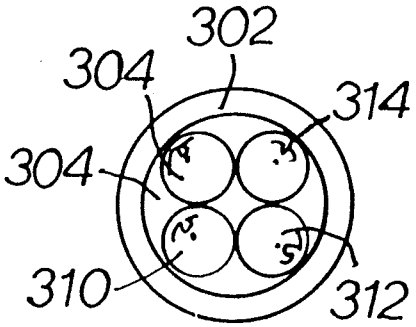
FIG. 18 is a cross-sectional view taken along line 18—18 in FIG. 17.
Figure 21:
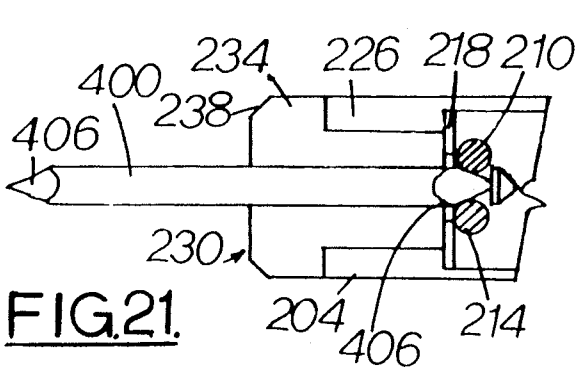
FIG. 21 is a partial sectional view of a driver and a headless fastener captured in a preferred embodiment of a capture assembly using a plurality of ball bearings.
Figure 24:
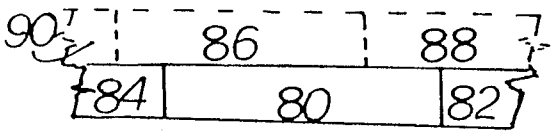
FIGS. 24 through 29 illustrate one embodiment of the steps incorporating the driver apparatus and headless fastener of the present invention.
Figure 25:
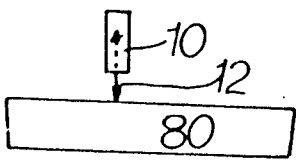
Figure 26:
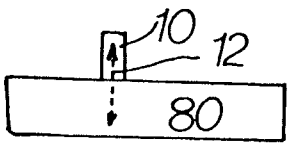

One other preferred embodiment will be described to illustrate the manner in which the present invention may be reduced to a few of its essential parts. Referring now to FIGS. 16 through 18 another preferred and elegant embodiment of the present invention is illustrated as a nail driver assembly 300. The depicted embodiment includes a combined driver and assembly housing 302 defining a combined nail guide and ball bearings assembly receiving recess 304. The recess 304 is deeper compared to the previously described preferred embodiments.

A ball bearings assembly 306 receives four ball bearings 308, 310, 312, and 314. The depth of the recess 304 is determined by the diameter of the ball bearings and length of a nail guide 316. The length of the nail guide 316 in this embodiment is determined by a desired depth to which a headless opposing points nail is to be driven into a receiving member. Typically, the length of the recess may be shorter than approximately half the length of the headless opposing points nail.

The nail guide 316 consists simply of a body portion 318 and a headless opposing points nail receiving bore 320 defined by the body portion 318. The nail guide 316 is placed inside the recess 304 in the combined driver and assembly housing 302 which, as previously mentioned, holds the point contacting ball bearings in position.

In use, aside from the aesthetic value found by the building industry in not seeing nail heads, there is a very practical value in the use of opposing points nails. One example is found when considering the construction of a wooden patio deck. The opposing points nail is driven into an edge of a floor plank and an edge of an adjacent floor plank is driven into the exposed nail point.

It will be further appreciated that setting the railing posts on the deck floor via opposing points nails replaces conventional toe nailing and provides a better looking and more easily accomplished joint. The construction of the present invention further provides a joint or plurality of joints able to support a greater floor load and provide greater floor support capacity than conventional construction techniques.

In operation, as depicted in FIGS. 24 through 29, a series of landscape ties 80 through 90 are constructed into a wall. The wall may provide both landscape aesthetics and a retaining wall when constructed. One point of headless opposing points nail 12 is inserted into a driver 10 (or any other driver constructed in accordance with the present invention).

Figure 30:
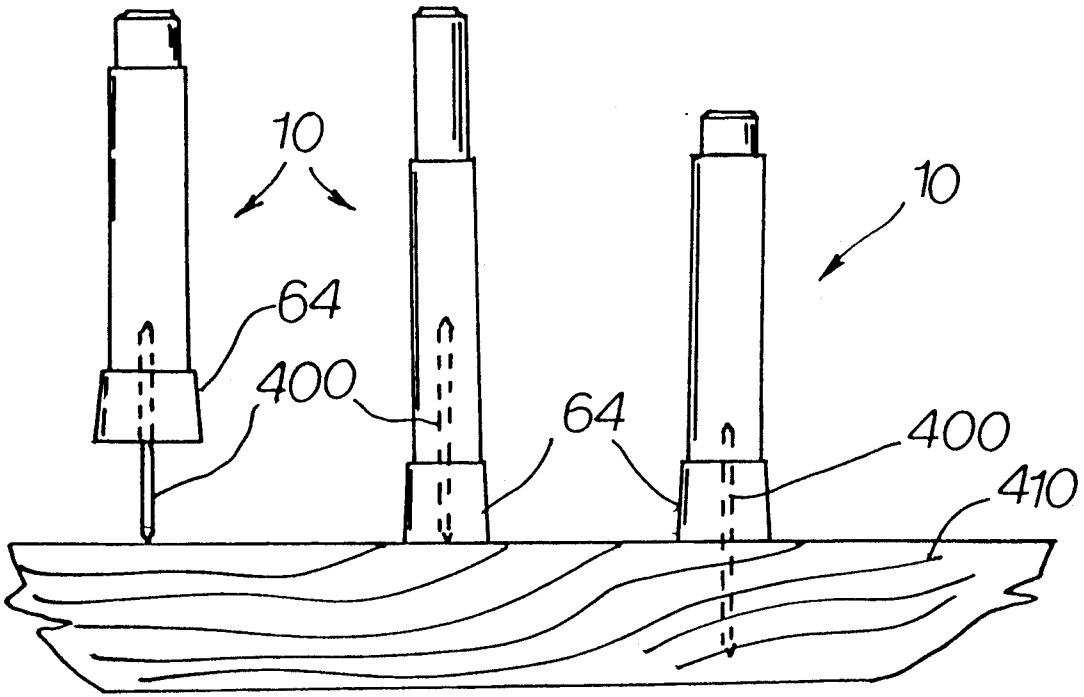
FIG. 30 illustrates a sequence for positioning a driver and nail.

Referring to FIG. 30, a driver 10 of the present invention is shown so as to view the headless opposing points nail 400 both in and out of the driver to illustrate the following action of this and other similar driver embodiments. The headless opposing points nail 400 is initially inserted into the driver 10. The driver 10 is positioned using the cross-hair arrangement of the nail guide holder 64, if necessary (a). The driver 10 and nail 400 are positioned against a deck plank 410 and holder 64 is pushed against the plank.

The driver shaft 16 is extended when the driver 10 is positioned against the plank 410 (or any other receiving member) and the headless opposing points nail 400 is prepared for driving into the plank (b). After shaft 16 is struck the headless opposing points nail is driven into the receiving member 410 (c).

Some additional considerations regarding operation of the present invention will now be discussed. These considerations may not be apparent from the foregoing description, however, it is believed that use of the present invention in most if not all of its embodiments would identify the following aspect of the invention for the user.

Special consideration may have to be given to the alignment of the driver and the headless opposing points nail with respect to the receiving member. It is suggested that the same considerations be applied when working with the present invention as when working with wooden dowels. The entry locations of the opposing points should be accurately marked on both receiving pieces allowing use of the cross-hair like projections to align the driver.

It may be useful to consider the entry locations as mirror images of each other. The headless opposing points nail will be perpendicular to the receiving members. While some offset may be acceptable, it will be recognized that an offset from perpendicular results in the headless opposing points nail attempting to shift laterally. This has a number of drawbacks, including a possibility that the receiving member may split.

Figure 29:
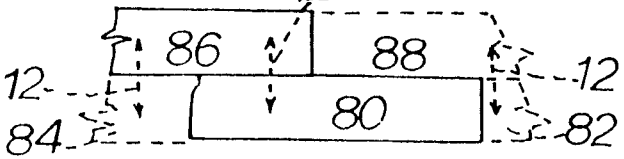
Figure 27:
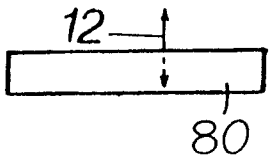
Figure 28:
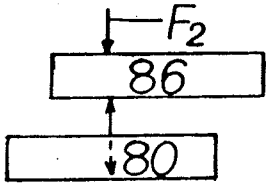

After the headless opposing points nail is driven into the receiving member the second receiving member is located adjacent the exposed point as generally depicted in FIGS. 27, 28, and 29. The second receiving member may have been marked with an entry location to assist in the joining of the two receiving members. Once the entry location is matched to the second receiving member, the second receiving member may be driven onto the exposed point.

It is believed that the need to identify entry locations on the receiving members will decrease with experience in using the driver of this invention.

Alignment may be accomplished without marking the receiving members by utilizing the receiving members as alignment aids. As an example, consider an application in which planks are laid on a joist system of a deck. The joist provides one aligning plane and another aligning plane may be provided by a structure next to which the deck is being built. With two such aligning aids it is only necessary to make reasonably sure that the headless opposing points nails are perpendicular to the receiving piece, or plank in this example.

In another application a cabinet maker may actually desire to drill undersized holes and end up using the headless opposing points nails just like dowels. Glue would probably be optional if headless opposing points nails were used instead of dowels.

It has been found that twisting the nail as it is inserted into the driver 10 provides a desired contact between the point and the ball bearings which are contained within a bearings keeper assembly of one of the nail driver assemblies of this invention. The ball bearings assembly delivers the impact force from the hammer (not shown) to the nail through the flat surfaces of the point while simultaneously protecting the nail point from damage while being driven.

This feature of the present invention allows the exposed nail point to be driven into another member, for example tie 86, by a driving force F2 on the tie 86. If the point is damaged, then the nail will not properly imbed in this receiving member. The nail guide 10 will be either sized for a predetermined nail diameter or variable diameter guide to provide for various diameters of nails. Upon completion, a tie wall is constructed in which all of the nails are hidden.

These nails have not been oversized since they were required only in their receiving members and did not have to be driven through adjacent members in order to provide the desired fastening.

When the nail 12 is inserted into the driver apparatus 10 with a twist it utilizes a "self-seating" feature and each wedge face seeks a ball bearing. The feathered portions travel into captured engagement intermediate adjacent bearings.

The ball bearings press on their respective wedge surfaces and the point advances through the open central portion of the bearings assembly and stops where it does not contact any portion of the driver assembly. Force F1 is transferred from the respective shaft member to the wedge surfaces. The bearings do not give way and the point is maintained in a safe, undamaged position between the bearings. The bearings accommodate a wide range of wedge surface angles and nail sizes.

It will now be understood that the nail and point angle of almost any nail can be accommodated by changing the size or the number of bearings within the respective recess. If necessary an additional bearings cup (not shown) can be provided for smaller bearings and a larger driver assembly can be used for relatively large headless nails or spikes.

In the embodiments of the present invention utilizing a fixed dimension nail guide and nail guide bore, the bore is preferably hexagonal to permit insertion of the feathered nail point into the respective driver assembly. The points of the shaped opening, e.g., hexagonal, permit passage of the point's feathered edges and the flat surfaces joining the points permit passage of the nail shaft. As discussed above, the driver assemblies incorporating interchangeable nail guides require changing the guides as the size (diameter) of the nails used changes.

The variable diameter embodiments of the present invention provide a similar operation. Initially, the size of the headless opposing points nail ("the nail") and the nail guide are determined by the particular task being performed. Once the size is determined the correct size nail guide is positioned (if not of the variable diameter type) and the nail is pushed into the nail driver assembly. The nail is inserted until the point comes to rest on the ball bearings as previously described.

The nail and driver are positioned and the driver shaft is struck with a hammer. The nail is thereby driven into the wood to the predetermined depth. The driver is removed by pulling it from the nail exposing the opposing point.

Experimentation has indicated that to obtain equal penetration of opposing receiving members with the present invention it may be desirable to observe the following guidelines. The guidelines take into consideration the relative resistance of driving a nail across the grain or against the grain.

When both receiving pieces or members are of the same type of wood it may be advantageous to match the cross grain of one receiving member with the cross grain of the other receiving member or the grain of one with the grain of the other. The headless opposing points nail could be driven first into either receiving member. If the cross grain of one receiving member is to be matched to the grain of the other receiving member, then it may be advantageous to start the headless opposing points nail in the cross grain piece.

Hardwood and softwood may often be joined with the present device and method. If that is the case, then it is suggested that the headless opposing points nail should be started in the hardwood.

It has been found that in joining opposing receiving members when driving the second work piece or receiving member onto the exposed point of the headless opposing points nail, use of a relatively heavy hammer facilitates the operation. It will be understood that scrap pieces placed between the second receiving member and the hammer can prevent hammer marks on the second receiving member.

Another useful suggestion is to drive relatively long second receiving members onto the exposed points of the headless opposing points nails, e.g., deck floor planks, by distributing driving blows along the length of the floor plank in order to provide short, relatively equal penetrations of the fasteners until the adjacent members are joined as desired.

In all the embodiments described above, the bore in the nail guides are generally circular. However, the bore could be square, hexagon or any other shape. The square or hexagon bores allow easier passage of nails with imperfect feathering.

From the foregoing description those skilled in the art will appreciate that all of the objects of the present invention are realized. An improved nail and nail driver have been shown and described that provide a fastener and tool for driving the specialized fastener and fastening objects together. With the nail and driver of this invention the nail head is concealed by the constructed object. The present invention provides an improved headless fastener with a nail comprising opposing point portions and an intermediate shaft portion.

In one embodiment the shaft portion includes means for preventing the fastener from being easily removed from a receiving member. In a preferred embodiment the shaft portion of the headless fastener or nail may include longitudinally spaced, outward projecting rings. The present invention provides an improved nail and driver that provide means for driving an opposing points nail to a desired depth and without damaging the points.

While specific embodiments have been shown and described, many variations are possible. The particular configuration of the headless opposing points nail may have projections on the shaft portion to increase the holding force of the nail. Ring shank nails have been found particularly suitable. The nail and driver materials may vary although standard nail metals are considered adequate.

Another variation of the above description is to substitute lead or other malleable material for the point contacting ball bearings assembly. This embodiment allows easy replacement of damaged material and provides a driver assembly that could be disposed of or a point contacting material that can be replaced as it becomes distorted with use.

The use of the present invention will be facilitated if the user of the driver and the headless opposing points nails plans ahead and uses care beyond that required by standard nailing practices. The reward will be a stong and aesthetically pleasing joint of which any practitioner of the craft would be proud.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A driver apparatus for guiding and driving a headless fastener, comprising:

means for driving a headless fastener, the driving means adapted for receiving a percussive, driving force;

means for receiving the headless fastener for driving, the receiving means protecting a point of the headless fastener from being deformed by the impact of the driving of the driving means, the receiving means operating in cooperation with the driving means and restraining the headless fastener within the apparatus while the percussive force drives the headless fastener into a receiving member, thereby guiding the headless fastener; and means for determining an extension of the headless nail outward from the driving means once driven into the receiving means, the extension thereby determined establishing the depth to which the headless fastener is driven into the fastener receiving means, the extension determining means operated in association with the driving means.

2. A driver apparatus as set forth in claim 1 wherein the driving means includes a sliding housing and driver shaft arrangement.

3. A driver apparatus as set forth in claim 2 wherein the headless fastener guiding means comprises a longitudinal, headless fastener receiving bore defined by the driver shaft.

4. A driver apparatus as set forth in claim 2 wherein a holding means includes headless fastener retaining means capturing an end of the headless fastener opposite the end driven into the fastener receiving member.

5. A driver apparatus as set forth in claim 1 wherein the receiving means comprises:

a longitudinal, headless fastener receiving bore defined by a bore in the headless fastener guiding means; and a capture assembly located within the longitudinal headless fastener receiving bore to capture an end of the headless fastener opposite the end driven into the receiving member.

6. A driver apparatus as set forth in claim 5 wherein the headless fastener receiving means further includes a variable diameter guide assembly for receiving, guiding and holding a shaft portion of the headless fastener inserted into the headless fastener receiving bore.

7. A driver apparatus for guiding and driving a headless fastener, comprising:

means for driving a headless fastener, the driving means adapted for receiving a precussive, driving force;

a shaft member;

a housing member, the housing member in a sliding arrangment with the shaft member, the housing member associated with the shaft member to slide longitudinally on an outer surface of the shaft member;

a longitudinal, headless fastener receiving bore defined by the shaft member, the bore extending generally along an imaginary longitudinal axis of the shaft member; and a headless fastener capture means at an inner end of the longitudinal bore for capturing an end of the headless fastener inserted into the driver apparatus and for protecting the end from being deformed by the impact of the driving of the driving means.

8. A driver apparatus as set forth in claim 7 wherein the capture means is sefl-adjusting and includes a recessed shaft end portion, the recess carrying a receiving means that receives an end of the headless fastener inserted into the capture means.

9. A driver apparatus as set forth in claim 8 wherein the receiving means is a ball bearing assembly.

10. A driver apparatus as set forth in claim 8 wherein the receiving means is an amount of a malleable material.

11. A driver apparatus as set forth in claim 7 wherein the apparatus further includes a variable diameter guide assembly for receiving and holding a shaft portion of the headless fastener inserted into the headless fastener receiving bore.

12. A driver assembly as set forth in claim 11 wherein a driver depth control means for determining the depth the headless fastener is driven into a headless fastener receiving member located intermediate the variable diameter guide assembly and the capture means.

13. A driver apparatus as set forth in claim 12 wherein the depth control means further includes a plurality of depth selection spacers used individually or in combination placed between the variable diameter guide assembly and the capture means.

14. A driver apparatus as set forth in claim 7 wherein the shaft member includes an interchangeable headless fastener guide having a center bore sized to accommodate a specific diameter headless fastener.

15. A driver apparatus as set forth in claim 7 wherein the shaft member includes a variable diameter headless fastener guide assembly.

16. A driver apparatus as set forth in claim 15 wherein the variable diameter headless fastener guide comprises:

a plurality of ball bearings holding the shaft of the headless fastener inserted into the driver apparatus; and biasing means operatively associated with the ball bearings, the biasing means urging the ball bearings towards the headless fastener shaft.

17. A driver apparatus as set forth in claim 7 wherein the shaft member includes an interchangeable headless fastener guide having a variable diameter headless fastener guide assembly.

18. A driver apparatus as set forth in claim 17 wherein the variable diameter headless fastener guide comprises:

a plurality of ball bearings holding the shaft of the headless fastener inserted into the driver apparatus;

biasing means operatively associated with the ball bearings, the biasing means urging the ball bearings towards the headless fastener shaft; and a bearing housing containing the ball bearing and biasing means.

19. A driver apparatus as set forth in claim 18 wherein the biasing means consists of a compressible bearing ring.

20. A driver apparatus as set forth in claim 7 which comprises a driver depth control means which determines the depth the headless fastener is driven into a headless fastener receiving member.

21. A driver assembly as set forth in claim 20 wherein the depth control means including a generally cylindrical spacer defining a generally longitudinal, headless fastener receiving, central bore.

22. A driver apparatus as set forth in claim 21 wherein the central bore diameter is chosen to receive a particular diameter headless fastener.

23. A driver apparatus as set forth in claim 22 wherein the driver depth control means for determining the depth the headless fastener is driven into the receiving member is located at an end of the longitudinal receiving bore prior to the capture means.

24. A driver apparatus as set forth in claim 23 wherein the depth control means further includes a plurality of depth selection spacers used individually or in combination placed between a nail guide and driver shaft.

* * * * *